US009162809B2

(12) United States Patent
Gillblad

(10) Patent No.: US 9,162,809 B2
(45) Date of Patent: Oct. 20, 2015

(54) FOOD PACKAGE WITH SUPPLEMENTARY FOOD CONTAINER

(75) Inventor: Rickard Gillblad, Onsala (SE)

(73) Assignee: Torus Pak Research and Development S.A.R.L., Luxembourg (LU)

( * ) Notice: Subject to any disclaimer, the term of this patent is extended or adjusted under 35 U.S.C. 154(b) by 0 days.

(21) Appl. No.: 13/700,054

(22) PCT Filed: May 27, 2011

(86) PCT No.: PCT/SE2011/050666
§ 371 (c)(1),
(2), (4) Date: Mar. 6, 2013

(87) PCT Pub. No.: WO2011/149421
PCT Pub. Date: Dec. 1, 2011

(65) Prior Publication Data

US 2014/0110302 A1 Apr. 24, 2014

(30) Foreign Application Priority Data

May 27, 2010 (SE) ..... 1050529

(51) Int. Cl.
*B65D 1/34* (2006.01)
*B65D 81/34* (2006.01)
(Continued)

(52) U.S. Cl.
CPC ..... *B65D 81/3453* (2013.01); *B65D 1/36* (2013.01); *B65D 77/2024* (2013.01);
(Continued)

(58) Field of Classification Search
CPC ..... B65D 1/36; B65D 81/3294; B65D 1/343; B65D 1/3453; B65D 1/3446; B65D 65/46; B65D 65/463; B65D 2581/3432; B65D 77/2024; B65D 81/3222; B65D 81/3453; B65D 2577/205; B65D 2577/2066; B65D 2581/3498; B65D 2581/3425; B65D 2581/3472; A23L 1/01
USPC ..... 206/561, 389, 560, 562, 563, 564, 565, 206/217, 541, 557, 549, 548, 223; 220/201, 220/260, 262, 265, 359.1, 359.2, 359.4, 220/915.1, 556, 555, 23.89, 23.87, 23.83, 220/527; 426/119, 120, 115; 229/904
See application file for complete search history.

(56) References Cited

U.S. PATENT DOCUMENTS 1,514,379 A * 11/1924 Fleischer ..... 206/229
2,703,287 A * 3/1955 Peters ..... 426/115
(Continued)

FOREIGN PATENT DOCUMENTS

CN 1826272 A 8/2006
CN 101143634 A 3/2008
(Continued)

OTHER PUBLICATIONS

International Search Report received for PCT Patent Application No. PCT/SE2011/050666, mailed on Oct. 6. 2011, 6 pages.
(Continued)

*Primary Examiner* — Anthony Stashick
*Assistant Examiner* — James M Van Buskirk
(74) *Attorney, Agent, or Firm* — Morrison & Foerster LLP

(57) ABSTRACT

A food tray comprising a side wall module, a lid and a bottom, where the bottom and the side wall module are held together in a detachable manner, where the bottom can be removed from the side wall module by the use of a removal means attached to the bottom, where the lid is attached to the upper rim of the food tray, where the tray further comprises a supplementary food container positioned in the tray, which is attached to the bottom in a detachable manner and which is fixedly attached to the lid of the food tray, and where the supplementary food container is opened when the bottom is removed from the side wall module. The advantage of the invention is that an additional food can be held separated from the rest of the food in a food tray but can be heated at the same time and that the supplementary food container is opened at the same time as the food tray is opened.

10 Claims, 3 Drawing Sheets

(51) Int. Cl.
*B65D 77/20* (2006.01)
*B65D 81/32* (2006.01)
*B65D 1/36* (2006.01)

(52) U.S. Cl.
CPC ..... *B65D 81/3222* (2013.01); *B65D 2577/205* (2013.01); *B65D 2577/2066* (2013.01); *B65D 2581/3425* (2013.01); *B65D 2581/3472* (2013.01); *B65D 2581/3498* (2013.01)

(56) References Cited

U.S. PATENT DOCUMENTS

| | | | | | |
|---|---|---|---|---|---|
| 3,179,320 | A * | 4/1965 | Ward | ..... | 206/564 |
| 3,708,086 | A | 1/1973 | Colato | | |
| 3,854,023 | A * | 12/1974 | Levinson | ..... | 219/730 |
| 4,013,798 | A * | 3/1977 | Goltsos | ..... | 426/107 |
| 4,190,757 | A * | 2/1980 | Turpin et al. | ..... | 219/730 |
| 4,577,080 | A * | 3/1986 | Grossman | ..... | 219/689 |
| 4,656,042 | A | 4/1987 | Risler | | |
| 4,687,117 | A * | 8/1987 | Terauds | ..... | 220/781 |
| 4,933,193 | A * | 6/1990 | Fisher | ..... | 426/107 |
| 4,942,277 | A * | 7/1990 | Narberes | ..... | 219/734 |
| 6,579,549 | B1 | 6/2003 | Thrasher et al. | | |
| 7,552,835 | B2 * | 6/2009 | Kiel et al. | ..... | 220/23.8 |
| 2002/0197360 | A1 | 12/2002 | Lamp et al. | | |
| 2009/0304877 | A1 * | 12/2009 | Gillblad | ..... | 426/234 |

FOREIGN PATENT DOCUMENTS

| | | | |
|---|---|---|---|
| CN | 101166678 | A | 4/2008 |
| EP | 2080713 | A1 | 7/2009 |
| WO | 2004/045970 | A1 | 6/2004 |
| WO | 2006/115457 | A1 | 11/2006 |

OTHER PUBLICATIONS

Invitation to Pay Additonal Fees received for PCT Patent Application No. PCT/SE2011/050666, mailed on Aug. 17, 2011, 6 pages.
International Preiminary Report on Patentability received for PCT Patent Application No. PCT/SE2011/050666, completed on May 22, 2012, 5 pages.
Office Action Received for Chinese Patent Application No. 201180026332.1, mailed on Feb. 21, 2014, 7 pages (2 page of English Translation of Search Report and 5 pages of Official Chinese Office Action).
Extended European Search Report (includes Supplementary European Search Report and Search Opinion) received for European Patent Application No. 11786997.4, mailed on Jun. 5, 2015, 4 pages.

* cited by examiner

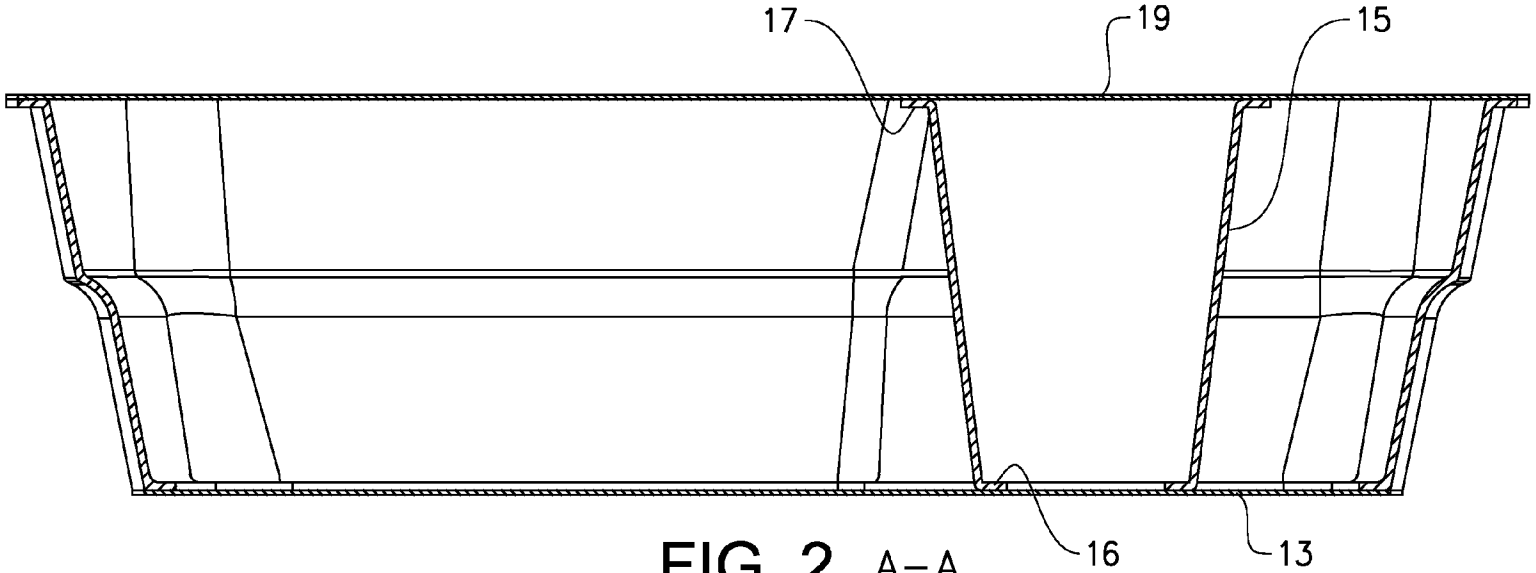
FIG. 2 A–A
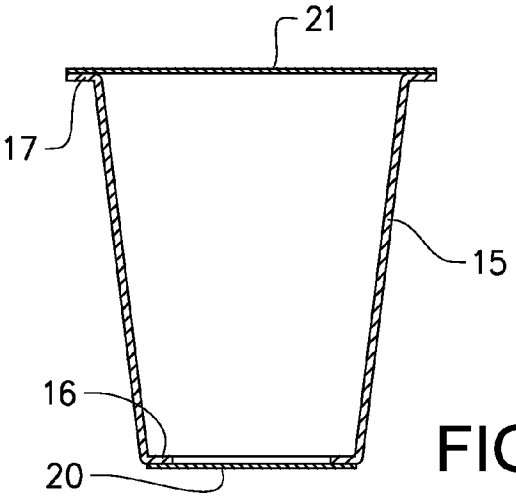
FIG. 4
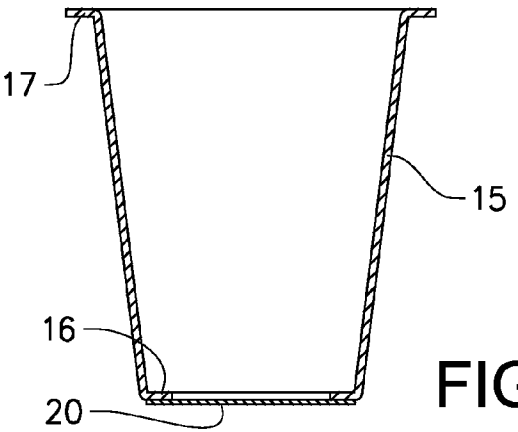
FIG. 3

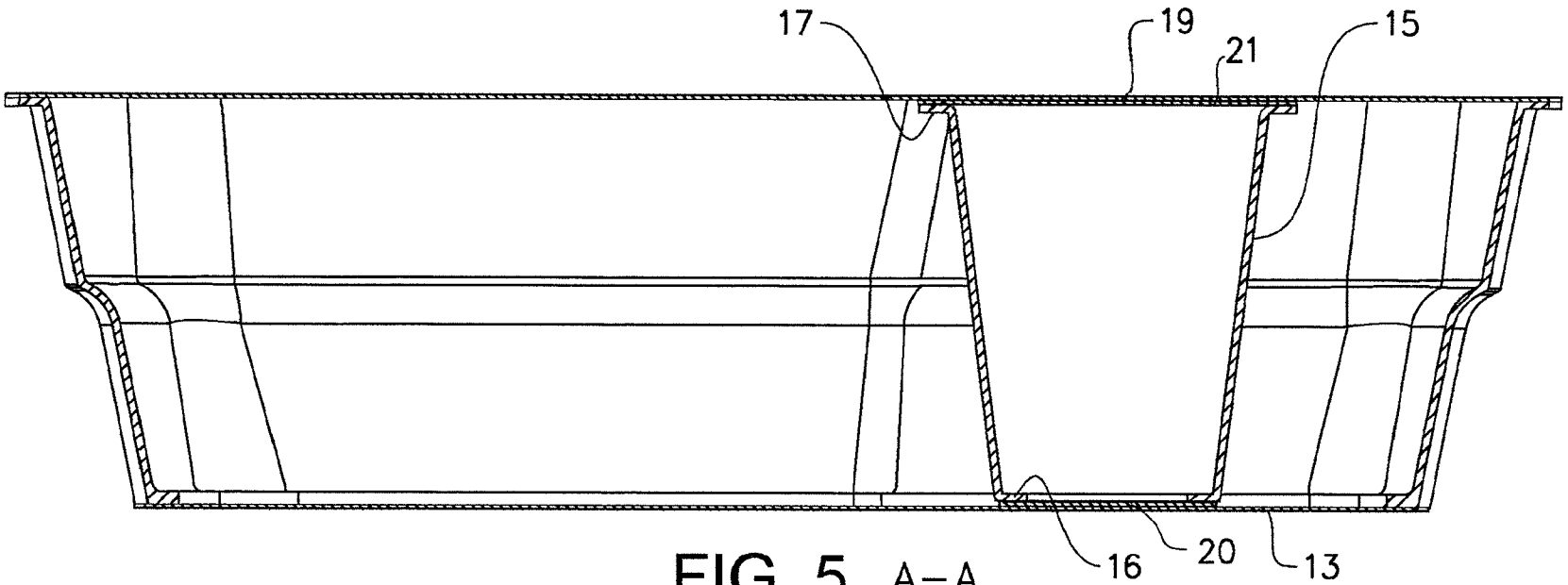
FIG. 5 A–A

FOOD PACKAGE WITH SUPPLEMENTARY FOOD CONTAINER

CROSS REFERENCE TO RELATED APPLICATIONS

This is a U.S. National Phase patent application of PCT/SE2011/050666, filed May 27, 2011, which claims priority to the Swedish Patent Application No. 1050529-5, filed May 27, 2010, each of which is hereby incorporated by reference in the present disclosure in its entirety.

TECHNICAL FIELD

The present invention relates to a food package adapted for ready meals and the like comprising a supplementary food container.

BACKGROUND ART

There is an increasingly large demand for meals that are simple to prepare and for which the preparation time is short. Sales of convenience foods or ready meals are increasing. These are sold in disposable packages and are adapted either to be eaten directly without heating, such as sushi, or to be heated before eaten.

Most ready meals are contained in a disposable package usually consisting of a tray manufactured from cardboard, metal or a plastic material with a thin, transparent plastic film serving as a lid. A plurality of different heating methods is available, depending on the packaging material. The most common tray material for single portion ready meals is plastic or paper, which allows the meal to be heated in a microwave oven. It is also possible to use a conventional oven or to place the package in hot water. The lid of the package is removed either before or after heating. The meal can be eaten directly from the pack when heated or it is possible to transfer the food from the package to a plate. During a transfer of the food, the presentation of the meal is destroyed and the food content will inevitable mix. If the food is frozen, it may be possible to transfer the food to a plate prior to heating without too much problems, but for a non-frozen meal, the transfer of food is not practical.

One way of solving the problem with the food mixing is to use a tray having different sections divided with dividing walls. Such a tray is manufactured in a single piece using a specific moulding tool or pressing tool. It is difficult to eat directly from such a tray, but the food can be transferred in a more controlled, however time consuming, way. Another disadvantage of such a package is that the different sections are fixed in size. Depending on the prepared meals, different packages may thus be needed for each type of meal.

One known package is described in WO 2004/045970 A1, in which the package is subdivided into different sections which are adapted to preserve different pressures during heating, and consequently will allow different temperatures in the different sections.

U.S. Pat. No. 3,708,086 A describes a package which is subdivided into different sections, which is adapted to be inverted after heating and having a specific lid acting as a plate.

WO 2006/115457 describes a food package in which the food is transferred to a plate by placing the package over a plate and then by removing the bottom part of the package. The food can in this way be transferred to the serving surface of the plate without any mixing of the food content. The ready meal will thereby retain the same orientation as it had before the transfer of the food. Some foods, such as sauce, may still intermix some with the other foods.

There may thus be a need for separating different foods in such a package, and also to allow for a different amount of heating of the different foods. There is thus still room for an improved food package.

DISCLOSURE OF INVENTION

An object of the invention is therefore to provide an improved food tray, in which different foods may be separated during heating. A further object of the invention is to provide a food tray, in which the different foods may be heated to different temperatures.

The solution to the problem according to the invention is described in the characterizing part of claim 1. The other claims contain advantageous embodiments and further developments of the food tray.

In a food tray comprising a side wall module, a lid and a bottom, where the bottom and the side wall module are held together in a detachable manner, where the bottom can be removed from the side wall module by the use of a removal means attached to the bottom and where the lid is attached to the upper rim of the food tray, the object of the invention is achieved in that the tray further comprises a supplementary food container positioned in the tray, which is attached to the bottom in a detachable manner and which is fixedly attached to the lid of the food tray, and where the supplementary food container is opened when the bottom is removed from the side wall module.

By this first embodiment of the food tray according to the invention, the food tray comprises a supplementary food container positioned in the tray. In this way, an additional food product can be held completely separated from the rest of the food in the tray, but can be heated at the same time as the tray is heated. The container of the additional food will be opened at the same time as the food tray is opened. The supplementary food container is thus attached to the removable bottom of the tray in a removable manner, such that both the tray and the supplementary food container are opened simultaneously when the removable bottom is peeled off. The supplementary food container is preferably fixedly attached to the lid of the food tray, such that the supplementary food container is held in place by the lid when the removable bottom is removed. The lid is for this reason attached to the upper rim of the food tray such that the lid stays in place when the bottom is removed. The lid is either fixedly attached to the upper rim or bears against the upper rim.

In an advantageous development of the invention, the supplementary food container comprises a separate bottom attached to a lower rim on the supplementary food container in a detachable manner, where the separate bottom is attached to the bottom of the tray in a fixed manner. This will allow the supplementary food container to be filled outside of the tray, in a separate filling station. This also allows the supplementary food container to be filled at a different moment or at a different location and to be stored before the supplementary food container is inserted into the food tray. By also providing the supplementary food container with a separate lid attached to an upper rim on the supplementary food container in a fixed manner, the freedom of choosing filling location is enlarged further. The separate lid is adapted to be attached to the lid of the food tray in a fixedly manner, such that the supplementary food container is held in place in the food tray when the removable bottom is removed.

In an advantageous development of the invention, the body of the supplementary food container comprises a material that is at least partly non-permeable to microwaves. In this way, the additional food in the supplementary food container can be shielded from all or part of the microwave radiation, which allows the additional food to be heated less than the rest of the food in the food tray. By also using a separate bottom and/or a separate lid comprising the same material, it is possible to control the radiation transferred to the additional food further. By e.g. using a material that is completely non-permeable to microwave radiation, it is possible to prevent the additional food to be heated almost completely.

In an advantageous development of the invention, the supplementary food container comprises a material that absorbs microwaves. In this way, the additional food in the supplementary food container can be exposed to an additional heating caused by infrared radiation. This material may be applied in the body of the supplementary food container, in the separate bottom and/or in the separate lid, depending on the requirements.

In another advantageous development of the invention, both a material that shields off microwaves and a material that absorbs microwaves are used in combination. It is e.g. possible to use a non-permeable material in the body and the separate bottom and an absorbing material in the lid.

BRIEF DESCRIPTION OF DRAWINGS

The invention will be described in greater detail in the following, with reference to the embodiments that are shown in the attached drawings, in which FIG. 2 shows a split view of the food tray according to the invention, FIG. 3 shows a split view of a supplementary food container comprising a separate bottom, FIG. 4 shows a split view of a supplementary food container comprising a separate bottom and a separate lid, and FIG. 5 shows a split view of the food tray according to the invention.

MODES FOR CARRYING OUT THE INVENTION

Figure 1:
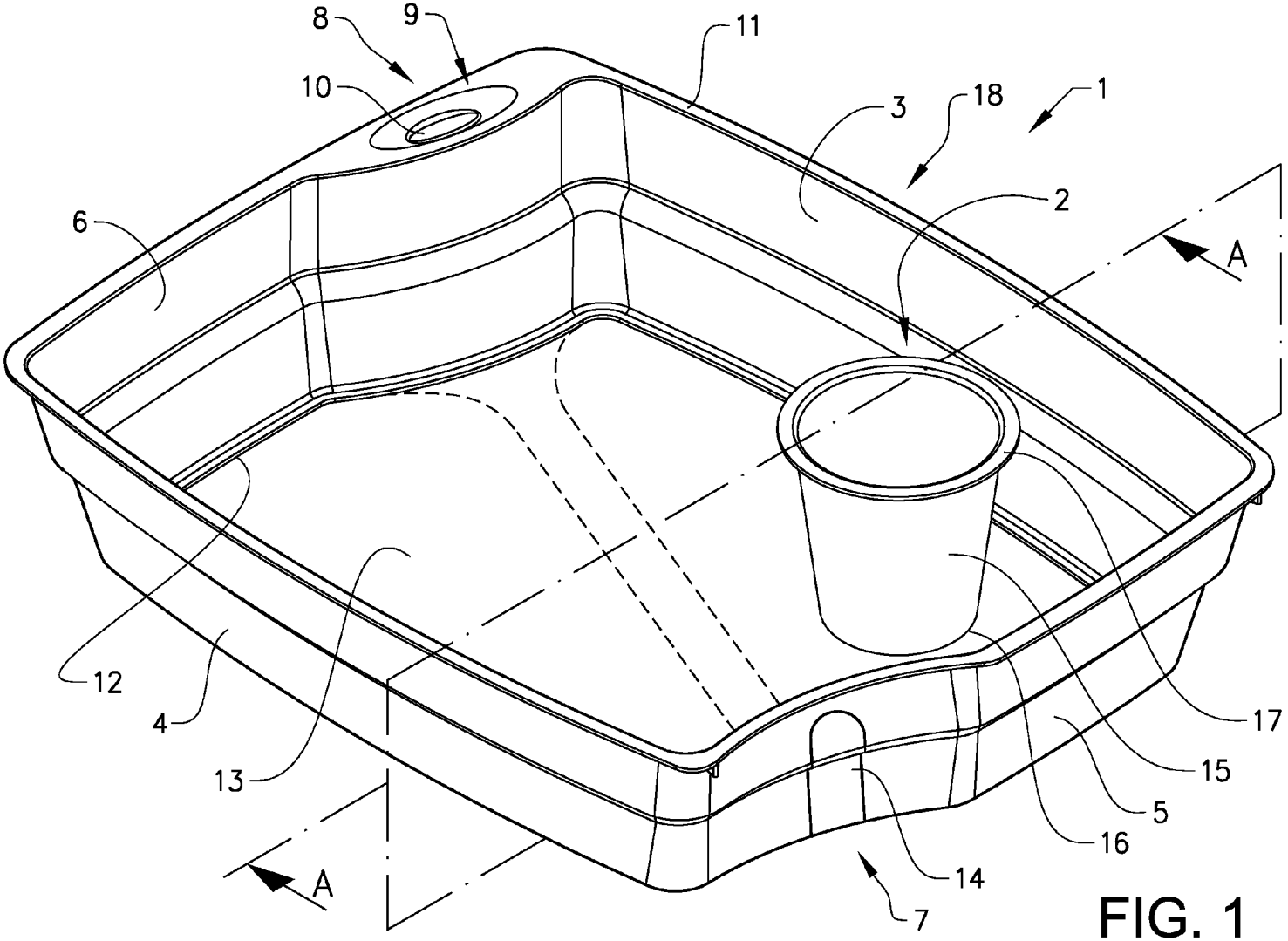
FIG. 1 shows a side view of a food tray comprising a supplementary food container according to the invention.

The embodiments of the invention with further developments described in the following are to be regarded only as examples and are in no way to limit the scope of the protection provided by the patent claims.

FIG. 1 shows a first embodiment of a food package in the form of a tray 1 comprising a supplementary food container 2. The tray 1 comprises in the shown example two longitudinal side walls 3, 4 and two transverse side walls 5, 6 interconnected to each other, thereby forming a side wall module 18 made in one piece. The tray further comprises a removable bottom 13. The side walls 3, 4 and 5, 6 are substantially perpendicular to each other, but other shapes, such as a round, an oval or an asymmetric shape, are also possible. A rectangular outer shape is however cost-efficient both to handle and to pack in larger quantities. The shown transverse side walls each comprise a concave section 7, 8. The concave section 7 is intended to hold the removal tab 14 of the removable bottom. The removal tab 14 is fixed to the removable bottom at the opposite end, i.e. at the end where the finger grip is positioned, which means that the removable bottom will start to peel off from this end when the removal tab is pulled. The concave section 8 is at the upper region delimited by a grip 9 at the upper rim 11 of the tray. The concave section 8 will provide a space for the fingers of a user such that the grip can be held in a secure way when the bottom 13 is removed. The grip 9 comprises an indentation 10 that will help the user to hold the package even more securely.

The side walls slope somewhat such that the food trays can be stacked in each other. This allows for an efficient transportation of empty food packages. The lower periphery is provided with a lower rim 12 that is adapted to receive a bottom foil that will constitute a bottom 13 of the tray. The bottom foil can be removed by pulling the removal tab 14. The removable bottom foil is preferably attached in a removable manner to the side wall module when the food tray is produced. There are different ways of achieving an attachment of the bottom that allows it to be removed in an easy way, but that will still provide a secure bottom for the food before the removal of the bottom. Since the removable bottom is peeled off, the local pulling strength acting on the joint will be relatively high which helps the removal of the bottom.

The upper periphery of the food package comprises an upper rim 11 that is adapted to receive a lid of some kind. The lid may be made from different materials but is preferably a transparent film that is attached to the upper rim after food has been put in the tray. The lid does not have to be removed from the tray when the food in the tray is to be served. This allows for an easier attachment of the lid, which is of great importance especially when the food tray is used by smaller establishments having simpler sealing machines. A removable lid requires higher tolerances when the lid is attached to the tray, but with the inventive tray, a tight and secure attachment of the lid may be obtained also with lower tolerances.

The food tray further comprises a supplementary food container 2. In the shown example, the supplementary food container is circular, but other shapes, such as a rectangular, a square, an oval or an asymmetric shape, are also conceivable. The supplementary food container comprises a body 15, a lower rim 16 and an upper rim 17. The supplementary food container is adapted to be inserted into the tray at the location of the food producer, after delivery of the tray. In this way, the trays may be efficiently transported in a stacked way. The body of the supplementary food container may also be inclined some in order to allow the supplementary food containers to be stacked in each other during transportation. The lower rim 16 preferably extends inwards towards the centre of the supplementary food container, but may also extend outwards. The upper rim 17 preferably extends outwards from the centre of the supplementary food container, but may also extend inwards. The direction of the upper and lower rims are thus optional, but the preferred directions allow for a cost-effective production tool and further allows the supplementary food containers to be stacked in each other in a compact way. The supplementary food container may be made from different material, such as different plastics, polymers and paper based materials.

When a tray is to be prepared with food in a filling station at the ready meal producer, a single tray is brought to a filling station. This may be either a manually operated filling station or an automated filling station. Before any food is inserted into the tray, the supplementary food container is inserted in the appropriate position, in the shown example in one of the corners. The lower rim 16 is provided with a somewhat tacky coating, which allows the supplementary food container to stick to the bottom and to seal the inner of the supplementary food container. The tacky coating will allow the bottom to be removed from the supplementary food container at the same time as the bottom is removed from the tray. Thus, the supplementary food container will adhere to the bottom but will not be rigidly attached to it. It is also possible to attach the supplementary food container to the bottom by using heat, in the same way as the bottom is attached to the side wall module.

With the supplementary food container in place, the food is inserted into the tray. This may be e.g. meat, potatoes and vegetables. An additional food product, such as e.g. sauce, is inserted into the supplementary food container. The advantage of placing the sauce in a supplementary food container is that the sauce will not mix with the food in the tray before the food is ready to serve. This will prevent the food to be contaminated by the additional food product during storage and transportation of the food tray. In this way, it is possible to prevent e.g. fried potatoes to be soaked with sauce which would inevitably destroy the crispness of the potatoes. Certain chemical reactions, which will start when some food products are mixed, can also be prevented by separating one of the food products. One such situation is discolouring of food by the additional food product, such as fish by a sauce, which is prevented by the separation of the food products.

When all food products are inserted into the food tray, a lid is mounted to the tray. The lid is preferably mounted to the tray in a heat sealing operation, but it is also possible to use lid that is not fixedly attached to the upper rim. Commonly known heat sealing apparatuses or machines comprising a heated plate may be used, but since the lid should not be removable, other materials, temperatures and processing times may be used. For the inventive food tray, it is of great importance that the lid is attached to the upper rim of the tray with an adhesion force that is higher than the adhesion force by which the bottom is attached to the lower rim such that the supplementary food container is held in place when the bottom is removed. The supplementary food container has in this example the same height that the side walls of the tray such that the upper rim 17 of the supplementary food container is in level with the upper rim 11 of the tray. In this way, the supplementary food container is sealed and attached to the lid at the same time as the lid is attached to the tray.

It is also possible to use a lid that is attached to the upper rim in a press-fit or snap-in manner, where the lid has an edge that overlaps the rim of the side walls, such that the edge of the lid rests on the upper rim. In this way, it is possible to use specific lids having a nicer appearance. Such a lid may be manufactured from a see-through, clear plastic film that is relatively stiff. The lid can have a shape that extends above the food tray. In order for the supplementary food container to attach to the lid, the height of the supplementary food container is adapted to the height of the lid. The lid may be fixedly attached to the food tray or may be held in place by interlocking means, such as protrusions or grooves.

In one development of the inventive food tray, the supplementary food container is provided with a separate bottom attached to the lower rim 16 of the supplementary food container in a removable manner. The separate bottom can be attached to the lower rim using an adhesive or by using a heat seal process. One advantage of using a heat seal process is that there is no risk that any food comes in contact with an adhesive, since some adhesives are not approved for the food industry. The underside of the separate bottom is in this example provided with an adhesive that will bind the separate bottom to the removable bottom of the tray. The separate bottom must adhere to the removable bottom of the tray with an adhesion force that is higher than the adhesion force between the separate bottom and the lower rim of the supplementary food container. In this way, the separate bottom will be removed with the removable bottom such that the supplementary food container will be opened when the tray is opened. When the food is in place in the tray, the tray is sealed in the same way as described above. One advantage of this is that the supplementary food container can be filled at a separate filling station prior to the insertion in the tray.

In a further development of the inventive food tray, the supplementary food container is, apart from a separate bottom, also provided with a separate lid attached to the upper rim 17 of the supplementary food container. The separate lid is in this example attached to the upper rim of the supplementary food container in a fixed manner, since there is no need to be able to open the lid. This may be obtained by using either an adhesive or a heat seal process. The separate lid must adhere to the upper rim of the supplementary food container with an adhesion force that is higher than the adhesion force between the separate bottom and the lower rim of the supplementary food container. In this way, the separate bottom will be removed with the removable bottom such that the supplementary food container will be opened when the tray is opened. When the food is in place in the tray, the tray is sealed in the same way as described above. During this sealing process, the supplementary food container together with the separate lid is also attached to the lid of the tray. One advantage of this is that the supplementary food container can be filled and sealed at a separate filling station prior to the insertion in the tray. This makes it possible to treat the additional food in a specific way, e.g. by using a specific protective gas for the additional food in the supplementary food container. It is also possible to e.g. let the additional food in the supplementary food container be treated in an ultra high temperature process in order to prolong the shelf life of the additional food. This is advantageous since some additional food, such as sauces, may be more sensitive to storage.

The supplementary food containers described above are held in place by adhesion to the bottom and the lid of the food tray. In another embodiment, the supplementary food container is lower than the side walls of the tray, and is instead attached to one or two of the side walls. In this case, the supplementary food container must be provided with a separate bottom and lid before it is inserted in the tray, since it can not be sealed with the lid of the tray. The supplementary food container is attached to the side walls by a suitable adhesive that will hold the supplementary food container attached to the side walls during the removal of the bottom of the tray.

The size of the supplementary food container may be adapted to the amount of additional food that is to be used for the ready meal in the food tray. Thus, different sizes of supplementary food containers may be used with the same tray, which allows for a flexible solution requiring only one base tray. When only a small portion of additional food is to be used, one small supplementary food container is inserted in the food tray. When more additional food is to be used, a larger supplementary food container can be inserted, or two small supplementary food containers may be used. When two supplementary food containers are used, it is also possible to position them in opposite corners of the food tray, thereby allowing for a more even spread of the additional food. It is also possible to use two supplementary food containers comprising different types of additional food that should not be mixed with the food in the food tray or with one another. This makes it possible to e.g. offer a dish with a white sauce and a dark sauce that are not mixed with each other.

In the above described food trays comprising a supplementary food container, the additional food in the supplementary food container is heated at the same time and with the same intensity as the food in the rest of the food tray. In some cases, there may be a need to heat the additional food in the supplementary food container to a less extent than the food in the rest of the food tray. This may be the case when the additional food is a sauce that should be heated to a lower temperature than the rest of the food. This is also the case when the additional food comprises a higher degree of water than the rest of the food, since food with higher water content will heat up faster when the food is heated in a microwave oven. For an ordinary sauce, this may mean that the sauce is too hot and may degrade before the rest of the food is warm.

Another situation when the food in the supplementary food container should be heated less than the rest of the food is when the additional food is fresh vegetables, such as a salad, that should not be heated very much or not at all. Another example of such a situation is when the ready meal is pancakes with whipped cream and jam. The tray is packed with pancakes, the whipped cream is in one supplementary food container and the jam is in another supplementary food container. The pancakes should e.g. be heated to 80 degrees, the jam to 40 degrees and the whipped cream should not be heated at all.

To allow for a reduced heating of the additional food, the supplementary food container may comprise a material that is more or less permeable to microwaves. By microwaves are meant electromagnetic waves adapted to heat food in a microwave oven. Such microwaves normally have a frequency of 2.45 GHz, but other frequencies in the lower GHz-range may also be used. Such a material may be used only in the body of the supplementary food container, but can also be used in the separate bottom and the separate lid, depending on how much radiation that is allowed to penetrate to the additional food. Materials that are more or less permeable to microwaves are well-known as such, and are normally laminated with different layers of materials, including at least one foil with one or more metal coating. The metal foil may be arranged in a specific pattern in order to control the amount of radiation that is reflected and/or transmitted by the material. A fully non-permeable material is also possible to use, as long as the size and shape of the outer surface does not reflect microwaves in such an amount that the magnetron is damaged.

In one example, it may suffice to manufacture the body of the supplementary food container from such a material. In this case, the supplementary food container is inserted into the tray and adhered to the bottom of the tray in the same way as described above. Such a supplementary food container may be used when the additional food is to be heated to some degree. When a larger shielding is required, the separate bottom and/or lid may also be made from such a material. With the body of the supplementary food container and both the separate bottom and the separate lid made from such a material, most or all of the microwave radiation may be shielded. This will stop the additional food from being heated almost completely. Some heat radiation from the rest of the food is of course inevitable.

For the example with pancakes above, the jam is contained in a supplementary food container made from a material shielding a part of the microwaves and with a regular bottom and lid, and the whipped cream is contained in a supplementary food container made from a material shielding microwaves and with both a separate bottom and a separate lid that also shields microwaves. In this way, the pancakes will be fully exposed to the microwaves, the jam will be exposed to a portion of the microwaves and the whipped cream will not be exposed to any of the microwaves. When the dish is ready, it is placed on a plate and the bottom is removed. The dish is now properly heated and nicely organised on the plate without any additional handling of the food.

In another example, the supplementary food container may comprise a material designed to absorb microwaves. Such a material may be applied in the supplementary food container body, in the separate bottom of the supplementary food container and/or in the separate lid of the supplementary food container, depending on the additional food. Such a material will absorb the microwaves and will heat up, which in turn initiates infrared radiation. Such a material is referred to as a susceptor and most often contain aluminum or ceramic in the form of a thin film having a specific pattern. It may e.g. be used when the surface of the additional food should get some additional colour, resembling a grilled or browned surface. This can e.g. be used to give bread croutons a final touch, to give a small pie a crustier bottom or to prepare the upper surface of a crème caramel.

It is also possible to use a supplementary food container with a separate bottom and/or separate lid having materials that both reflect microwaves and that absorb microwaves. In one example, the supplementary food container and the separate bottom are made from a material that is non-permeable or partly permeable to microwaves and the lid is made from a material that absorbs microwaves. Such a supplementary food container can be used for an additional food that is not to be heated by the microwaves, but that should have a browned surface. On example is sweet pepper that should not be completely cooked but nevertheless should have a nice grilled touch to the surface. Other combinations are also possible depending on the type of additional food.

The invention is not to be regarded as being limited to the embodiments described above, a number of additional variants and modifications being possible within the scope of the subsequent patent claims. The supplementary food container may have any size and shape and may be made from any suitable material.

REFERENCE SIGNS

1: Food tray
2: Supplementary food container
3: Longitudinal side wall
4: Longitudinal side wall
5: Transverse side wall
6: Transverse side wall
7: Concave section
8: Concave section
9: Grip
10: Indentation
11: Upper rim
12: Lower rim
13: Bottom
14: Removal tab
15: Body
16: Lower rim
17: Upper rim
18: Side wall module
19: Tray lid
20: Separate bottom
21: Separate lid

The invention claimed is:

1. A food tray comprising:
a side wall module,
a lid and
a removable bottom,
wherein the removable bottom and the side wall module are held together in a detachable manner,
wherein the removable bottom can be removed from the side wall module by the use of a removal tab fixedly attached to the removable bottom,
wherein the lid is attached to the upper rim of the food tray, wherein the food tray further comprises a supplementary food container positioned in the food tray, the supplementary food container is attached to the removable bottom in a detachable manner, and the entire supplementary food container is fixedly attached to the lid of the food tray, and wherein the supplementary food container is opened only at a bottom thereof so that the entire supplementary food container stays with the lid and the entire content of supplemental container can be released, when the removable bottom is removed from the side wall module by use of the removal tab.

2. Food tray according to claim 1, wherein the lid is fixedly attached to the upper rim of the food tray.

3. Food tray according to claim 1, wherein the supplementary food container further comprises a separate bottom attached to a lower rim on the supplementary food container in a detachable manner, and wherein the separate bottom is attached to the bottom of the tray in a fixed manner.

4. Food tray according to claim 3, wherein the supplementary food container further comprises a separate lid attached to an upper rim on the supplementary food container in a fixed manner, and wherein the separate lid is attached to the lid of the tray in a fixedly manner.

5. Food tray according to claim 1, wherein the body of the supplementary food container comprises a material that is at least partly non-permeable to microwaves.

6. Food tray according to claim 3, wherein the separate bottom of the supplementary food container comprises a material that is at least partly non-permeable to microwaves.

7. Food tray according to claim 4, wherein the separate lid of the supplementary food container comprises a material that is at least partly non-permeable to microwaves.

8. Food tray according to claim 1, wherein the body of the supplementary food container comprises a material that absorbs microwaves.

9. Food tray according to claim 3, wherein the separate bottom of the supplementary food container comprises a material that absorbs microwaves.

10. Food tray according to claim 4, wherein the separate lid of the supplementary food container comprises a material that absorbs microwaves.

* * * * *